US008544699B2

(12) United States Patent
Quam

(10) Patent No.: US 8,544,699 B2
(45) Date of Patent: Oct. 1, 2013

(54) NON-ROTATING SINGLE POST RAM FOR INDUCTOR PUMP

(75) Inventor: Paul R. Quam, Minneapolis, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 323 days.

(21) Appl. No.: 12/930,638

(22) Filed: Jan. 12, 2011

(65) Prior Publication Data

US 2011/0171042 A1 Jul. 14, 2011

Related U.S. Application Data

(60) Provisional application No. 61/294,322, filed on Jan. 12, 2010.

(51) Int. Cl.
*F04F 1/06* (2006.01)

(52) U.S. Cl.
USPC ..... 222/261; 222/386

(58) Field of Classification Search
USPC ..... 222/386, 387, 389, 261, 260; 92/165 PR; 417/118
See application file for complete search history.

(56) References Cited

U.S. PATENT DOCUMENTS 2,630,248 A * 3/1953 Hinz ..... 222/258
2,925,941 A * 2/1960 Bloxom ..... 222/254
3,412,903 A * 11/1968 Van Riper, Jr. et al. .... 222/146.5
3,430,812 A * 3/1969 Bielskis et al. ..... 222/14
3,518,920 A 7/1970 Bimba
3,546,430 A * 12/1970 Kane ..... 392/448
3,601,285 A * 8/1971 Leger et al. ..... 222/250
3,630,494 A * 12/1971 Patton ..... 366/60
3,976,229 A * 8/1976 Jackson ..... 222/146.5
3,982,669 A * 9/1976 Moore ..... 222/146.5
4,073,409 A * 2/1978 Gardner et al. ..... 222/146.5
4,090,640 A * 5/1978 Smith et al. ..... 222/52
4,130,205 A 12/1978 Luthi
4,195,755 A * 4/1980 Slautterback et al. ..... 222/146.5
4,355,734 A * 10/1982 Moore ..... 222/63
4,389,001 A * 6/1983 Franklin ..... 222/63
4,651,897 A * 3/1987 Johnson ..... 222/55
4,790,456 A * 12/1988 Nakane et al. ..... 222/183
4,792,063 A * 12/1988 Moore ..... 222/146.5
5,005,612 A * 4/1991 Kurtz ..... 141/7
5,117,998 A 6/1992 Handzel (Continued)

FOREIGN PATENT DOCUMENTS

GB 2099080 A 12/1982

OTHER PUBLICATIONS

Graco Product Brochure, "Check-Mate ram package selection guide", pp. 1-16, printed Dec. 2010.

(Continued)

*Primary Examiner* — Kevin P Shaver
*Assistant Examiner* — Donnell Long
(74) *Attorney, Agent, or Firm* — Kinney & Lange, P.A.

(57) ABSTRACT

An inductor pump system comprises a pump system, a ram system and a bearing assembly. The pump system includes a platen configured to engage a container. The ram system comprises a cylinder configured to support the pump system, and a piston extendable from the cylinder to vary axial positioning of the platen with respect to the container. The bearing assembly links the piston to the cylinder and is configured to prevent rotation of the pump system with respect to the ram system.

20 Claims, 4 Drawing Sheets

(56) References Cited

U.S. PATENT DOCUMENTS

| | | | | |
|---|---|---|---|---|
| 5,257,723 | A * | 11/1993 | Bagung | 222/1 |
| 5,609,091 | A | 3/1997 | Stoll | |
| 5,615,598 | A | 4/1997 | Noroy et al. | |
| 5,761,985 | A | 6/1998 | Stoll | |
| 5,865,089 | A | 2/1999 | Langer et al. | |
| 6,003,732 | A * | 12/1999 | Farley et al. | 222/146.5 |
| 6,152,015 | A | 11/2000 | Migliori | |
| 6,281,461 | B1 | 8/2001 | Doughty | |
| 6,637,316 | B2 | 10/2003 | Engelke et al. | |
| 7,013,792 | B2 | 3/2006 | Yamaguchi | |
| 7,033,066 | B2 | 4/2006 | Helder | |
| 8,070,021 | B2 * | 12/2011 | Stanton et al. | 222/334 |
| 2001/0025864 | A1 * | 10/2001 | Meyer | 222/261 |

OTHER PUBLICATIONS

Graco Product Brochure, "Graco Supply Systems, Sealant & Adhesive Supply Systems with NXT™ Technology", pp. 1-12, © 2006, 2007.

* cited by examiner

NON-ROTATING SINGLE POST RAM FOR INDUCTOR PUMP

CROSS-REFERENCE TO RELATED APPLICATION(S)

This application claims priority under 35 U.S.C. §120 to U.S. provisional application Ser. No. 61/294,322, entitled "NON-ROTATING SINGLE POST RAM," filed Jan. 12, 2010 by inventor Paul R. Quam, the contents of which are incorporated by this reference.

BACKGROUND

The present invention relates generally to inductor pumps for pumping highly viscous fluid from containers. In particular, the present invention relates to ram posts that extend from linear actuators for lifting and lowering platens used to push the fluid from the container.

Inductor pumps typically comprise a linear pneumatic ram that forces a pipe having a platen into a drum. The platen includes a central bore that leads to a passageway in the pipe. As the platen is lowered into the drum by the pneumatic ram, the highly viscous fluid is forced into the central bore and up the passageway. The fluid is pushed into a pneumatically operated pump that forces pressurized fluid through a hose and into a dispensing device where an operator can dispense a metered amount of fluid into some other typically smaller container.

Typical pneumatic rams comprise a piston that is configured to extend from a cylinder when pneumatic pressure is applied between ends of the cylinder and piston. The piston and cylinder are typically round in cross-section, thus allowing the piston to rotate within the cylinder. Operators of inductor pump systems must carefully align the container with the platen to avoid binding. Large inductor pump systems include a pair of rams that straddle the platen and container. The platen is thus immobile with respect to lateral movement between the platen and container. An operator need only ensure that the container is aligned with the platen. In smaller inductor pump systems, only a single ram is used such that the platen is capable of rotating with respect to the container. Thus, an operator must maintain both the platen and the container in alignment. Additional brackets and guides must be externally mounted to the pump system to immobilize lateral movement of the platen. There is, therefore, a need for an inductor pump system that more readily aligns the platen with a container.

SUMMARY

The present invention is directed to inductor pump systems and bearing assemblies for ram posts used in inductor pump systems.

In one embodiment of the invention, an inductor pump system comprises a pump system, a ram system and a bearing assembly. The pump system includes a platen configured to engage a container. The ram system comprises a cylinder configured to support the pump system, and a piston extendable from the cylinder to vary axial positioning of the platen with respect to the container. The bearing assembly links the piston to the cylinder and is configured to prevent rotation of the pump system with respect to the ram system.

In another embodiment of the invention, an end cap assembly comprises a ring body, a bearing sleeve and a ram post seal. The end cap ring body comprises an outer diameter having a profile to match that of an interior of a hydraulic cylinder, and an inner diameter having a bearing pocket and a seal groove. The bearing sleeve comprises an outer periphery that fits into the bearing pocket, and an inner periphery having a non-round profile to mate with a ram post. The ram post seal comprises an outer periphery that fits into the seal groove, and an inner periphery having a non-round profile matching that of the bearing sleeve.

DETAILED DESCRIPTION

Figure 1:
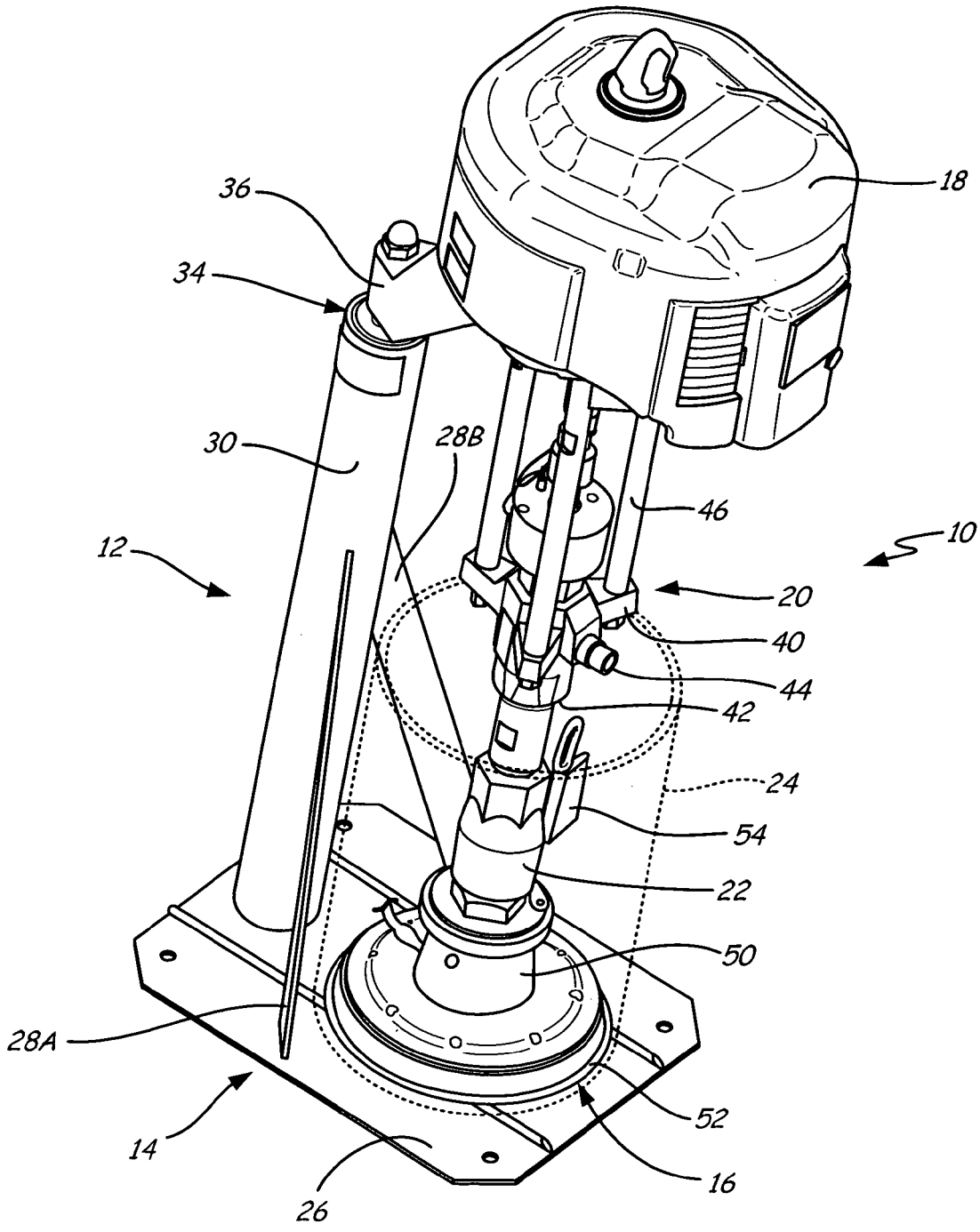
FIG. 1 is a perspective view of an inductor pump system having a non-rotating ram post of the present invention disposed within a ram cylinder.
Figure 2:
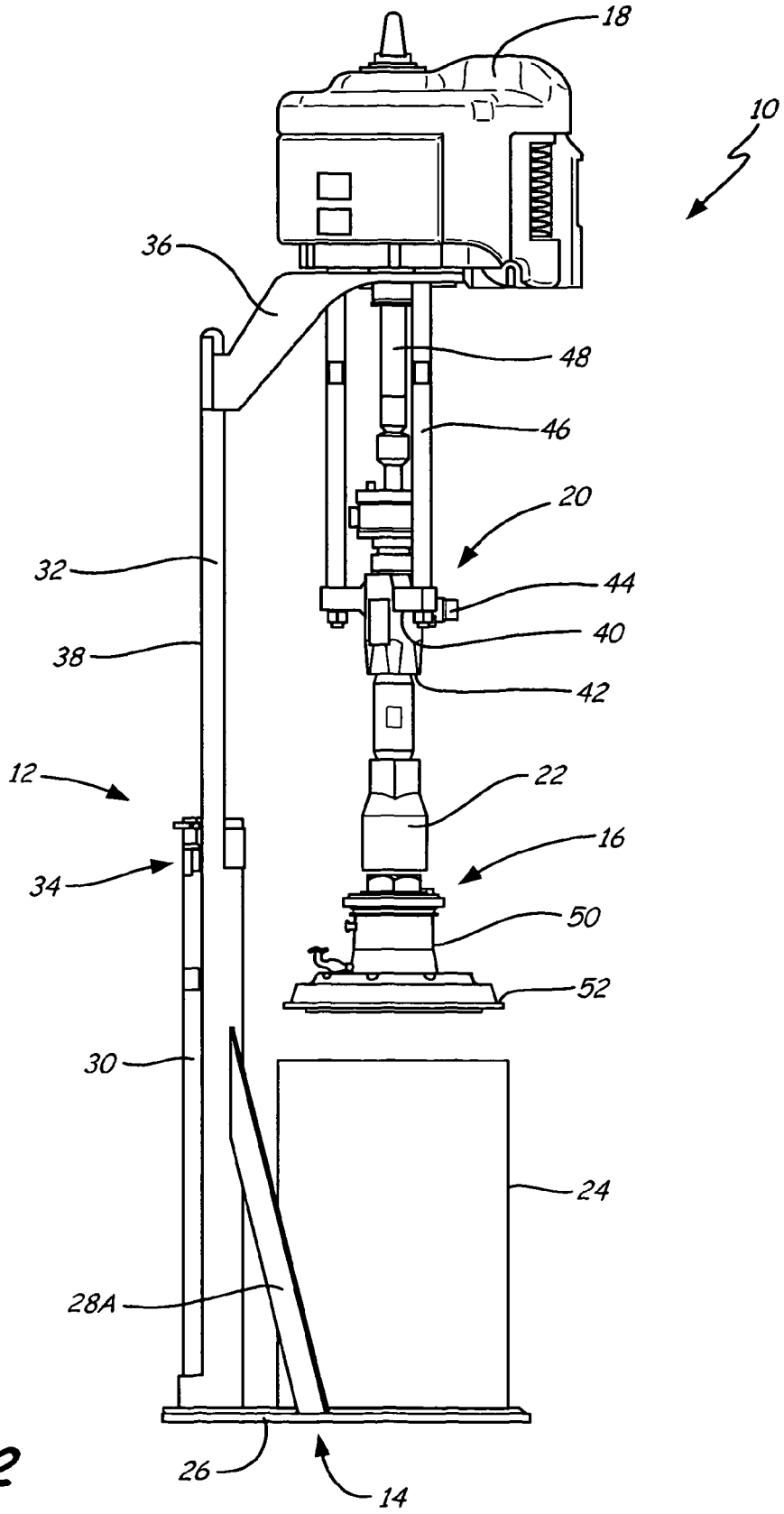
FIG. 2 is a side view of the inductor pump system of FIG. 1 in which the ram post (partially in section) is extended from the ram cylinder.

FIG. 1 is a perspective view of inductor pump system 10 having ram 12 including a non-rotating ram post of the present invention. FIG. 2 is a side view of inductor pump system 10 having ram 12 including a non-rotating ram post of FIG. 1. FIGS. 1 and 2 are discussed concurrently. Inductor pump system 10 also includes base 14, platen assembly 16, air motor 18, pump 20 and ram pipe 22. Platen assembly 16 and ram pipe 22 are shown disposed within container 24, which is shown in phantom in FIG. 1. Base 14 comprises platform 26 and supports 28A and 28B. Ram 12 includes cylinder 30, piston 32 (FIG. 2), bearing assembly 34 and bracket 36. Piston 30 includes bearing surface 38 (FIG. 2). Pump 20 includes housing 40, inlet 42, outlet 44 and mounting pins 46. Air motor 18 includes output shaft 48 (FIG. 2). Platen assembly 16 includes hub 50, wiper ring 52, and bleed stick 54 (FIG. 1).

Piston 32 is fully seated within cylinder 30 of ram 12, as shown in FIG. 1, and extends to lift platen assembly 16 from container 24, as shown in FIG. 2. Piston 32 is also referred to as a ram post. Platform 26 of base 14 is connected to a lower end of cylinder 30 and extends underneath platen assembly 16 to receive container 24. Supports 28A and 28B extend from side edges of platform 26 on either side of container 24 up to an upper portion of cylinder 30. Base 14 thus provides a footprint wide enough to prevent tipping of inductor pump system 10. Support bracket 36 is mounted to a top, exposed end of piston 32. Air motor 18 is mounted to the top of support bracket 36. Pump 20 is suspended from the bottom of support bracket 36 by pins 46 that connect to housing 40. Drive shaft 48 extends from air motor 18 to connect with pump 20. Pump 20 is connected to ram pipe 22 at inlet 42 and to a dispensing device (not shown) through a hose at outlet 44. Hub 50 of platen assembly 16 connects to ram pipe 22.

In operation, pressurized air from a separate air source (not shown) is provided to air controls to operate ram 12 and air motor 18. An inlet of air motor 18 and cylinder 30 of ram 12 receive pressurized air from the air controls. Ram 12 is used to lift support bracket 36 up and away from platform 26 such that an empty container can be removed from platform 26 and a full container can be positioned between platform 26 and platen assembly 16. Specifically, the air controls are operated so that pressurized air is delivered to ram 12 and allowed to enter cylinder 30. The pressurized air travels to the bottom of cylinder 30 and pushes piston 32 up and out of cylinder 30, pushing support bracket 36 away from platform 26 and lifting platen assembly 16 out of container 24. Bearing assembly 34 prevents air from leaking out of cylinder 30.

Container 24, which is filled with a fluid or viscous material that is to be dispensed by system 10, is disposed on platform 26 so that container 24 is accessible to platen assembly 16. As will be discussed in greater detail with reference to FIG. 3, bearing assembly 34 engages piston 32 to prevent bracket 36 from moving laterally with respect to platform 26. As such, alignment of platen assembly 16 with container 24 is more easily accomplished by an operator.

An operator adjusts the air controls to provide pressurized air to the top of cylinder 30 to push piston 32 downward, allowing platen assembly 16 to fall into container 24. Platen assembly 16 enters container 24, and the weight of platen assembly 16 and the air pressure against piston 32 pushes material into a central bore located in hub 50 such that the material travels into ram pipe 22 and up to pump 20. An operator adjusts the air controls to permit pressurized air to flow to air motor 18, which causes air motor 18 to actuate drive shaft 48. Depending on the type of pump used, drive shaft 48 rotates or reciprocates to drive pump 20. Pump 20 pressurizes the material provided by ram pipe 22 and distributes the pressurized material to outlet 44. A dispensing device connected to pump 20 at outlet 44 is used to meter material pressurized by system 10.

As material from container 24 is consumed, platen assembly 16 falls to the bottom of container 24. Wiper ring 52 of platen assembly 16 engages the side of container 24 to push the viscous material downward and into pipe 22. As platen assembly 16 descends into container 24, wiper ring 52 deflects to engage the sidewalls of container 24 to seal and scrape against container 24. Bleed stick 54 can be manually actuated to allow airflow into and out of container 24 through a vent in hub 50. To remove platen assembly 16 from container 24, an operator again adjusts the air controls to provide pressurized air to cylinder 30 and uses bleed stick 54 to permit air to enter container 24.

As mentioned above, bearing assembly 34 of the present invention prevents platen assembly from moving laterally with respect to platform 26. Specifically, bearing surface 38 of piston 32 engages with a mating bearing surface in bearing assembly 34 to prevent piston 32 from rotating within cylinder 30. This also prevents bracket 36 from rotating about cylinder 30 such that an operator need only align platen assembly 16 with container 24 once. Continuously holding bracket 36 in place while platen assembly 16 descends into container 24 is not needed. Furthermore, with platen assembly 16 withdrawn from container 24, bracket 36 will not rotate air motor 18, pump 20 and platen assembly 16 laterally away from platform 26 such that the center of gravity of pump system 10 does not change. Thus, the footprint of platform 26 and brackets 28A and 28B can be reduced without the need to accommodate a range of lateral positions of the pump components of system 10.

Figure 3:
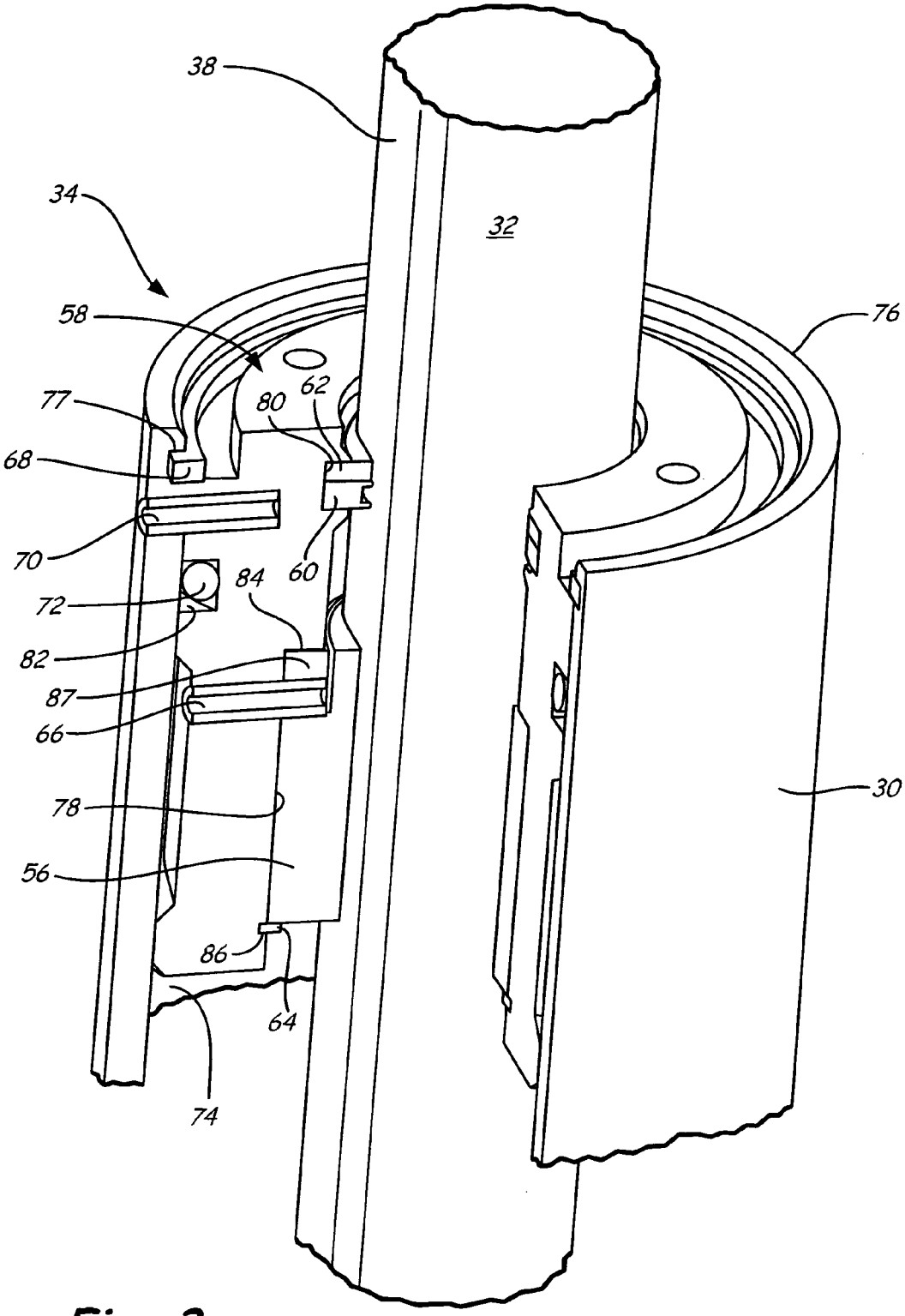
FIG. 3 is a perspective view of the ram post of FIG. 1 with a quarter section removed from the cylinder to show connection of a bearing assembly.

FIG. 3 is a perspective view of piston 32 of FIG. 1 with a quarter section removed from cylinder 30 to show connection of bearing assembly 34. Bearing assembly 34 includes bearing sleeve 56, end cap 58, piston seal 60, seal ring 62, first retaining ring 64, first retaining pin 66, second retaining ring 68, second retaining pin 70 and cap seal 72. Piston 32 includes bearing surface 38. Cylinder 30 includes interior 74, upper end 76 and ring groove 77. End cap 58 includes bearing pocket 78, inner seal groove 80 and inner seal groove 82. Pocket 78 includes shoulder 84 and ring groove 86.

An upper end of piston 32 extends from interior 74 of cylinder 30 at upper end 76. Bearing assembly 34 maintains piston 32 properly aligned within cylinder 30, prevents piston 32 from rotating within cylinder 30 and prevents air from escaping cylinder 30. End cap 58 is positioned within interior 74 at upper end 76. In various embodiments, end cap 58 is comprised of metal, such as a carbon steel or stainless steel, or plastic, such as a nylon or polytetrafluoroethylene (PTFE). End cap 58 comprises a sleeve having an outer periphery and an inner periphery. In one embodiment, end cap 58 comprises an annulus having a radial outer diameter and a radial inner diameter. The outer periphery of end cap 58 faces towards cylinder 30 and the inner periphery of end cap 58 faces towards piston 32.

The outer periphery of end cap 58 couples to cylinder 30 using second retaining ring 68 and second retaining pin 70. Retaining pin 70 extends through a hole in cylinder 30 and into a mating bore in end cap 58. In the described embodiment, retaining pin 70 comprises a metal spring pin that is compressed within the hole of cylinder 30 and bore of end cap 58. Retaining pin 70 prevents rotation of end cap 58 relative to interior 74 of cylinder 30. Retaining pin 70 is one of three retaining pins spaced equally around the circumference of cylinder 30. Retaining ring 68 prevents outward axial displacement of end cap 58. Retaining ring 68 comprises a split ring that flexes to fit into groove 77. Ring 68 extends partially into groove 77 of cylinder 30 and partially overhangs an upper end surface of end cap 58. Outer seal groove 82 engages cylinder 30 to trap and compress cap seal 72, which inhibits air from leaking out of cylinder 30. In the disclosed embodiment, cap seal 72 comprises a rubber O-ring seal.

The inner periphery of end cap 58 couples with bearing 56 and piston seal 60. Bearing 56 is secured to the inner periphery of end cap 58 using first retaining ring 64 and first retaining pin 66. Specifically, bearing 56 is positioned against shoulder 84 of pocket 78. Retaining pin 66 extends through a hole in end cap 58 and into mating detent 87 in bearing 56. In the described embodiment, retaining pin 66 comprises a metal spring pin that is compressed within the hole of end cap 58 and bore of bearing 56. Retaining pin 66 prevents rotation of bearing 56 relative to end cap 58. Retaining pin 66 is one of three retaining pins spaced equally around the circumference of bearing 56. Retaining ring 64 prevents axial displacement of bearing 56. Retaining ring 64 comprises a split ring that flexes to fit into groove 86. Ring 64 extends partially into groove 86 of end cap 58 and partially overhangs an inner end surface of bearing 56. Inner seal groove 80 is disposed on the inner periphery of end cap 58 to face piston 32 and is configured to retain piston seal 60 and ring 62. Piston seal 60 comprises a flexible and resilient material that can be deformed to fit within groove 80. Ring 62 comprises a split ring that flexes to fit into groove 80. Ring 62 extends partially into groove 80 and partially overhangs piston seal 60.

Mounted as such, seal 60 and bearing 56 engage piston 32 when piston 32 is inserted into end cap 58. Specifically, bearing 56 includes mating geometric features that mount flush with bearing surface 38 of piston 32 to prevent rotation of piston 32. Bearing 56 comprises a rigid material that has a low coefficient of friction. As such, bearing surface 38 of piston 32 is inhibited from rotating and deforming bearing 56, but bearing surface 38 can slide along bearing 56 to allow piston 32 to extend from cylinder 30. In one embodiment, bearing 56 is comprised of plastic, such as a nylon or PTFE.

Piston seal 60 includes mating geometric features that mount flush with bearing surface 38 of piston 32 to prevent air from escaping interior 74 at piston 32. Piston seal 60 tightly engages the entire periphery of piston 32. In one embodiment, piston seal 60 is comprised of rubber. Ring 62 comprises a disk-like body that is positioned axially outward of piston seal 60 to cover and protect seal 60. Ring 62 also assists in keeping piston seal 60 engaged with piston 32. In one embodiment, ring 62 is comprised of metal, such as a carbon steel or stainless steel.

Figure 4:
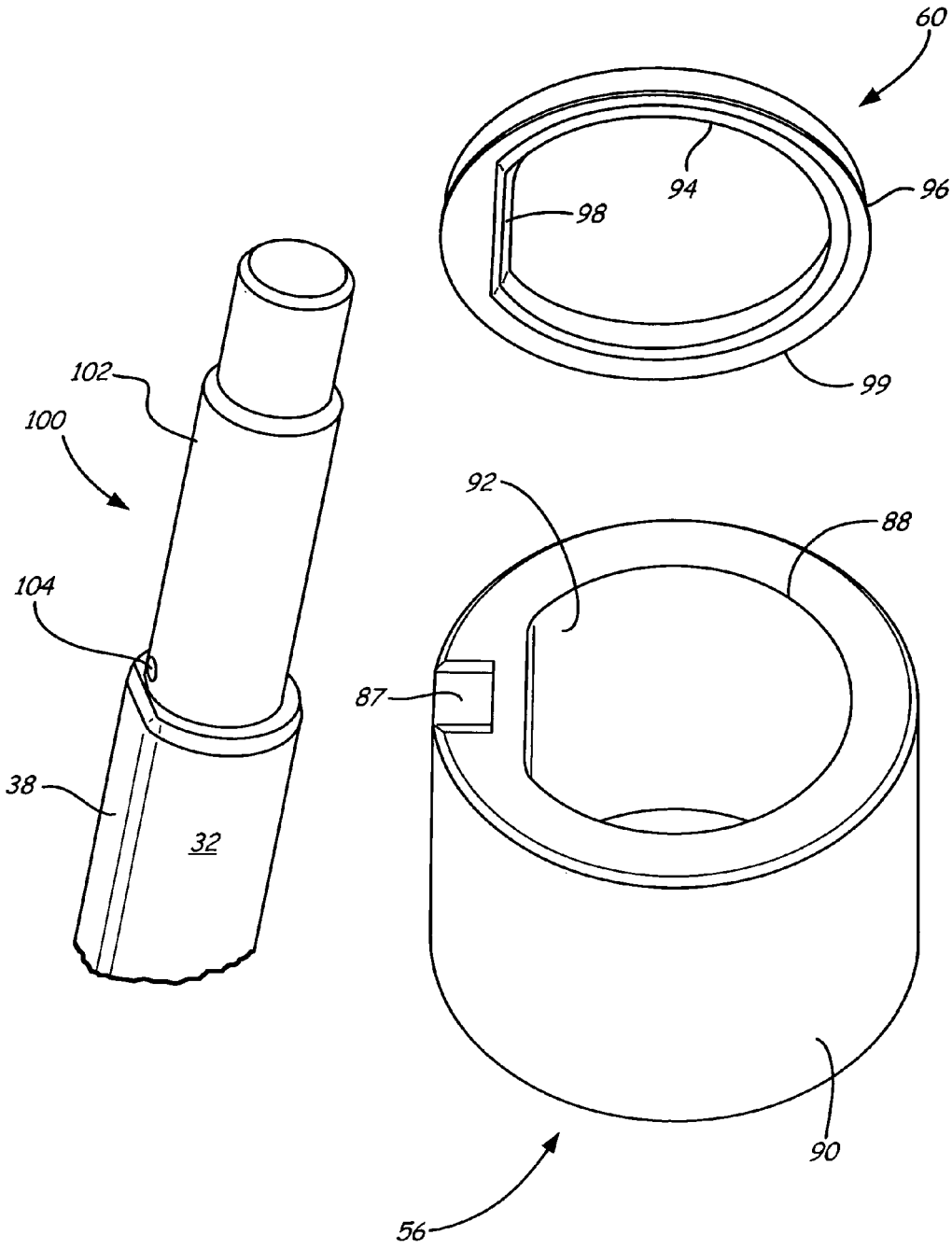
FIG. 4 is an exploded view of the bearing assembly of FIG. 3 showing a bearing surface on the ram post, a bearing and a seal.

FIG. 4 is an exploded view of bearing assembly 34 of FIG. 3 showing bearing surface 38 on piston 32, bearing 56 and piston seal 60. Bearing 56 and piston seal 60 are shown enlarged with respect to piston 32 in FIG. 4 so that the features of the present invention are better seen. Bearing 56 includes detent 87, inner periphery 88, outer periphery 90 and flat 92. Seal 60 includes inner periphery 94, outer periphery 96, flat 98 and gland 99.

Piston 32 comprises an elongate ram post that has a non-round cross-sectional profile. In the embodiment shown, piston 32 has a D-shaped cross-sectional profile. In other embodiments, piston 32 can have other non-round cross-sectional profiles, such as square or oval. Typically, piston 32 comprises a round post that is machined to include bearing surface 38. Bearing surface 38 comprises a flat portion that engages bearing 56 to prevent relative rotation. In other embodiments, piston 32 can be cast or otherwise manufactured with an inherent non-rotation feature such as bearing surface 38.

Piston 32 includes upper end 100 for coupling with bracket 36 (FIG. 1). Upper end 100 includes post 102 around which a bore in bracket 36 is positioned. A pin can be inserted through a hole in bracket 36 and into bore 104 to prevent bracket 36 from rotating on piston 32. Alternatively, post 102 can be square of have another shape to prevent rotation of bracket 36. Bearing 56 is assembled with end cap 58 and cylinder 30 (FIG. 3) such that bracket 36 extends over platform 26 (FIG. 2) when flat 92 of bearing 56 aligns with bearing surface 38 of piston 32. For convenience, hole 104 is typically placed perpendicular to bearing surface 38.

Outer periphery 90 of bearing 56 is coupled to end cap 58 such as by positioning retaining pin 66 in detent 87. Inner periphery 88 of bearing 56 is fitted around piston 32 and has a profile that mates with the cross-sectional profile of piston 32. Bearing 56 fits snuggly around piston 32 to reduce play or leeway between inner periphery 88 and piston 32 without disadvantageously interfering with axial movement of piston 32. Specifically, inner periphery 88 is sized to push flat 92 firmly flush against bearing surface 38 to prevent rotation of piston 32. Inner periphery 88 is also sized to provide a level of air sealing between piston 32 and bearing 56 in addition to that provided by piston seal 60.

Outer periphery 96 of seal 60 is positioned within groove 80 to engage end cap 58 while inner periphery 94 engages piston 32. Inner periphery 94 has a profile that mates with the cross-sectional profile of piston 32. Seal 60 fits snuggly around piston 32 to reduce or eliminate the ability of air to flow between piston 32 and seal 60. For example, seal 60 produces an interference fit with piston 32. Specifically, flat 98 of seal 60 engages flush with bearing surface 38. Corners of seal 60 between flat 98 and the arcuate portion of inner periphery 94 are provided with additional material such that adequate sealing is provided at the corners of bearing surface 38. Inner periphery 94 includes gland 99 to engage piston 32. Gland 99 includes an arcuate surface that faces piston 32 to trap a volume of air between piston 32 and seal 60. The arcuate surface includes a flange that deflects to tightly seat against piston 32 to prevent air from within cylinder 30 from penetrating into gland 99. The flange can deflect when piston 32 moves and changes direction within cylinder 30 while other portions of seal 60 remain engaged with piston 32.

The present invention provides an end cap assembly for an inductor pump system that prevents a ram post from rotating within a hydraulic cylinder. The end cap includes a flexible, non-round seal that mates with a non-round ram post to prevent air from escaping the cylinder. The end cap also includes a rigid, non-round bearing that mates with the non-round ram post to prevent the ram post from spinning within end cap assembly. The end cap assembly is itself mounted to the cylinder in a non-rotatable manner to prevent the end cap from spinning within the cylinder. As such a pump system comprising an air motor, pump, and platen mounted to the cylinder will not rotate with respect to a base of the cylinder where a platform and container of material for the pump system are positioned. Immobilizing movement of the pump system with respect to the container facilitates alignment of the container with the platen, thereby facilitating expedient operation of the inductor pump system. Additionally, the size of the platform that supports the cylinder can be kept small, as the weight of the pump system cannot be moved laterally to reposition the center of gravity of the inductor pump system. Furthermore, the end cap assembly can be used with conventional cylinders and ram posts, such as by machining cylindrical ram posts. The end cap assembly is self-contained within the cylinder such that external brackets and guides to immobilize the pump system are not needed.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An inductor pump system comprising:

a pump system for dispensing a fluid from a container;

a base for receiving the container; and a fluid activated ram for positioning the pump system axially with respect to the base, the fluid activated ram comprising:

a cylinder comprising:

an upper end;

a lower end mounted to the base; and an interior;

a piston comprising:

a first end disposed within the interior of the cylinder; and a second end extending from the upper end of the cylinder and to which the pump system is mounted;

wherein the piston comprises a non-round cross-sectional profile;

a bearing assembly coupled to the cylinder and engaging the piston to permit the piston to slide axially from the cylinder and to prevent the piston from rotating within the cylinder;

wherein the bearing assembly comprises:

a bearing disposed between the cylinder and the piston, the bearing including:

an outer periphery that faces the cylinder; and an inner periphery having a non-round profile to engage the cross-sectional profile of the piston;

a cylindrical end cap connected to the upper end of the cylinder and positioned between the interior of the cylinder and the outer periphery of the bearing; and a first retaining ring coupled to the cylinder to axially secure the cylinder end cap to the cylinder;

a first retaining pin connected to the cylinder end cap and the cylinder to prevent rotation of the cylinder end cap with respect to the cylinder; and an O-ring seal disposed between the cylinder and the end cap.

2. The inductor pump system of claim 1 wherein the piston includes a flat surface extending at least partially along a length of the piston between the first end and the second end.

3. The inductor pump system of claim 1 wherein the cylinder end cap comprises an outer periphery having a profile to engage the interior of the cylinder; and an inner periphery having a pocket to receive the outer periphery of the bearing.

4. The inductor pump system of claim 3 and further comprising:

a second retaining ring coupled to the cylinder end cap to axially secure the bearing to the pocket; and a second retaining pin connected to the cylinder end cap and the bearing to prevent rotation of the bearing with respect to the cylinder end cap, the second retaining pin extending perpendicular to the piston.

5. The inductor pump system of claim 3 and further comprising:

a seal disposed between the cylinder end cap and the piston, the seal comprising:

an outer periphery engaging the cylinder end cap;

an inner periphery having a non-round profile to mate with the cross-sectional profile of the piston; and a gland extending along the inner periphery that forms an air seal against the piston.

6. The inductor pump system of claim 5 and further comprising:

a rigid seal retaining ring disposed radially outward of the seal to maintain the gland in contact with the piston.

7. The inductor pump system of claim 1 wherein the pump system comprises:

a bracket connected to the second end of the piston to overhang the base;

a motor mounted to the bracket and having a drive shaft;

a pump coupled to the bracket and connected to the drive shaft; and a platen connected to the pump.

8. The inductor pump system of claim 1 wherein the base comprises:

a platform coupled to the lower end of the cylinder to face the pump system; and a pair of support brackets each extending between an edge of the platform and the upper portion of the cylinder.

9. An inductor pump system comprising:

a pump system including a platen configured to engage a container;

a ram system comprising:

a cylinder configured to support the pump system; and a piston extendable from the cylinder to vary axial positioning of the platen with respect to the container;

an end cap disposed within the cylinder;

a bearing assembly linking the piston to the end cap within the cylinder and configured to prevent rotation of the pump system with respect to the ram system; and a seal disposed between the piston and the end cap, the seal including a gland that forms an air seal against the piston.

10. The inductor pump system of claim 9 wherein:

the piston comprises a non-round cross-sectional profile; and the bearing assembly further comprises:

a bearing sleeve connected to the end cap and having an inner diameter through which the piston extends, the inner diameter mating with the non-round cross-sectional profile of the piston to prevent rotation of the piston within the cylinder.

11. The inductor pump system of claim 10 wherein the seal mates around an entire periphery of the non-round cross-sectional profile.

12. The inductor pump of claim 9 wherein the seal comprises:

an outer periphery engaging the end cap; and an inner periphery having a non-round profile to mate with the cross-sectional profile of the piston.

13. The inductor pump system of claim 9 and further comprising:

a rigid seal retaining ring disposed radially outward of the seal to maintain the gland in contact with the piston.

14. The inductor pump system of claim 9 and further comprising:

a retaining ring coupled to the end cap to axially secure the bearing to the end cap; and a retaining pin connected to the end cap and the bearing to prevent rotation of the bearing with respect to the end cap.

15. The inductor pump of claim 9 and further comprising:

a retaining ring coupled to the cylinder to axially secure the end cap to the cylinder; and a retaining pin connected to the end cap and the cylinder to prevent rotation of the end cap with respect to the cylinder.

16. An inductor pump system comprising:

a pump system including a platen configured to engage a container;

a ram system comprising:

a cylinder configured to support the pump system; and a piston extendable from the cylinder to vary axial positioning of the platen with respect to the container;

an end cap disposed within the cylinder;

a bearing assembly linking the piston to the end cap within the cylinder and configured to prevent rotation of the pump system with respect to the ram system;

a first retaining ring coupled to the cylinder to axially secure the end cap to the cylinder; and a first retaining pin connected to the end cap and the cylinder to prevent rotation of the end cap with respect to the cylinder.

17. The inductor pump system of claim 16 wherein the piston comprises a non-round cross-sectional profile; and the bearing assembly further comprises:

a bearing sleeve connected to the end cap and having an inner diameter through which the piston extends, the inner diameter mating with the non-round cross-sectional profile of the piston to prevent rotation of the piston within the cylinder.

18. The inductor pump system of claim 17 wherein the bearing assembly further comprises:

a seal that mates around an entire periphery of the non-round cross-sectional profile.

19. The inductor pump system of claim 18 wherein the seal comprises:

an outer periphery engaging the end cap;

an inner periphery having a non-round profile to mate with the cross-sectional profile of the piston; and a gland extending along the inner periphery that forms an air seal against the piston.

20. The inductor pump system of claim 16 and further comprising:

a second retaining ring coupled to the end cap to axially secure the bearing to the end cap; and a second retaining pin connected to the end cap and the bearing to prevent rotation of the bearing with respect to the end cap.

* * * * *